United States Patent [19]

Schär

[11] 4,052,017

[45] Oct. 4, 1977

[54] METHOD AND APPARATUS FOR AUTOMATICALLY CHANGING TEXTILE BOBBINS ON A CANTILEVERED BOBBIN CHUCK OF A TEXTILE WINDING MACHINE

[75] Inventor: Hugo Schär, Dattlikon, Switzerland

[73] Assignee: Rieter Machine Works Ltd., Winterthur, Switzerland

[21] Appl. No.: 675,446

[22] Filed: Apr. 9, 1976

[30] Foreign Application Priority Data

Apr. 16, 1975 Switzerland ..... 4829/75

[51] Int. Cl.[2] ..... B65H 67/04

[52] U.S. Cl. ..... 242/35.5 A; 242/18 DD

[58] Field of Search ..... 242/18 R, 18 DD, 18 PW, 242/35.5 A, 53, 41, 35.5 R

[56] References Cited

U.S. PATENT DOCUMENTS

| | | | |
|---|---|---|---|
| 3,762,661 | 10/1973 | Lucke | 242/53 X |
| 3,801,030 | 4/1974 | Kobatake et al. | 242/35.5 A X |
| 3,820,730 | 6/1974 | Endo et al. | 242/35.5 A X |
| 3,908,918 | 9/1975 | Bergstrom | 242/18 PW X |
| 3,915,398 | 10/1975 | Corl | 242/35.5 A |
| 3,964,723 | 6/1976 | Schippers et al. | 242/41 X |

*Primary Examiner*—John Petrakes
*Attorney, Agent, or Firm*—Werner W. Kleeman

[57] ABSTRACT

A method of, and apparatus for, automatically changing textile bobbins on a cantilevered bobbin chuck of a textile winding machine, wherein there is cut and sucked-off a thread moving towards a textile bobbin package placed on the bobbin chuck, the textile bobbin package is removed from the stopped bobbin chuck and transferred to a bobbin transporting device held in readiness, then positioning an empty bobbin tube, placing the empty bobbin tube onto the stopped bobbin chuck, and rethreading the sucked-off thread onto the empty bobbin tube placed on the bobbin chuck which, in the meantime, has been set into rotation.

15 Claims, 15 Drawing Figures

Fig. 4
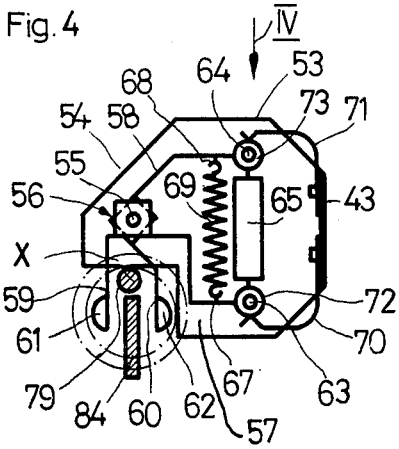
Fig. 6
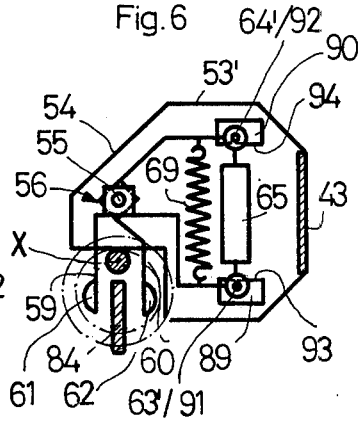
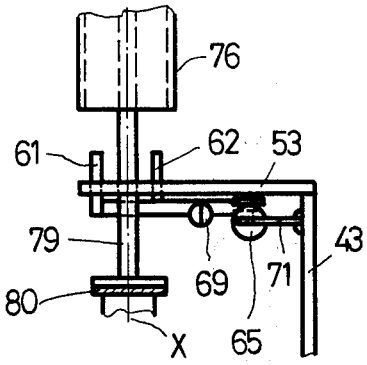
Fig. 5
Fig. 7
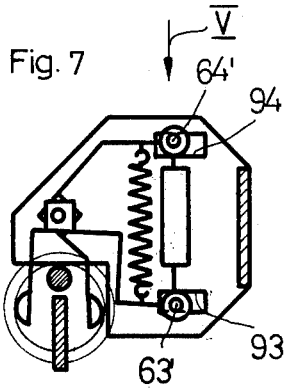
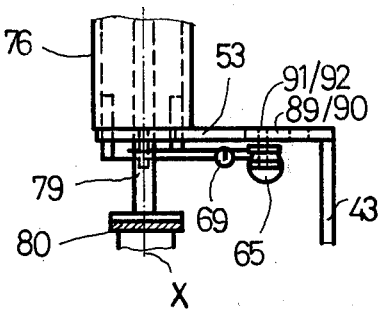
Fig. 8

METHOD AND APPARATUS FOR AUTOMATICALLY CHANGING TEXTILE BOBBINS ON A CANTILEVERED BOBBIN CHUCK OF A TEXTILE WINDING MACHINE

BACKGROUND OF THE INVENTION

The present invention relates to a new and improved method of automatically changing textile bobbins on a cantilevered bobbin chuck of a textile winding machine, and further concerns a new and improved bobbin changing apparatus for implementing the aforesaid method. The bobbin change apparatus is of the type comprising a bobbin tube gripper axially movable in the take-off of doffing direction arranged within two end positions on a rigidly arranged bobbin chuck for taking-off a bobbin tube supporting a wound bobbin package and for transferring it onto a supporting bolt of bobbin package transporting device held in readiness.

Changing devices for removing or taking-off full bobbin packages from a cantilevered bobbin chuck and for transferring them onto a bolt of a bobbin creel held in readiness are known already to the art. One prior art device of this type consists of a trolley which is movable on rails along a row of winding machines and which is pivotable about its vertical axis, and provided with a number of bobbin package take-off devices corresponding to the number of bobbin packages to be simultaneously taken-off. The bobbin take-off devices consist of a bobbin tube gripper movable along a straight horizontal path. The bobbin tube gripper is moved from a starting position linearly towards the bobbin chuck for gripping the bobbin tube. In this arrangement the bobbin tube gripper is arranged on and coaxially with respect to the gripper movement path. Upon gripping the full bobbin package tube the gripper is moved in the opposite direction along the same path until the full bobbin package tube sufficiently clears the bobbin chuck. Subsequently the trolley is pivoted about its vertical axis in such a manner that the full bobbin packages can be shifted onto a bobbin creel provided with supporting bolts by a reverse movement of the bobbin tube gripper. Thereafter, the gripper and the trolley are again moved back to their starting position, so that the changing device is ready for the next take-off of full bobbin packages.

A disadvantage of a changing device of this type resides in the fact that the gripper is arranged coaxially on its path of movement. It thus is necessary to pivot the gripper through 180° in order that the bobbin package can be transferred to the bobbin creel.

A further drawback is present in that no empty tube can be placed onto the empty gripper since at the position where such an empty tube could be placed there is present the bobbin creel.

Furthermore, neither a thread cutting and suction device, nor a thread re-piecing device are combined with the changing device, so that for a fully mechanically operating bobbin change device the following operations are to be additionally executed by hand:

a. Cutting and sucking off the thread.

b. Placing the empty tube onto the bobbin chuck.

c. Threading-up the thread onto the empty tube placed onto and accelerated upon the bobbin chuck.

SUMMARY OF THE INVENTION

Hence, it is a primary object of the present invention to eliminate the aforementioned drawbacks.

Another and more specific object of the present invention aims at a new and improved method of, and apparatus for, automatically changing textile bobbins on a cantilevered bobbin chuck of a textile winding machine in an extremely efficient and reliable manner.

Still a further object of the invention aims at perfecting a bobbin tube change operation with a minimum of movement, and further, fully automatically changing and transferring the thread to a new empty bobbin tube.

Yet a further object of the present invention is to devise a novel method of, and apparatus for, automatically changing textile bobbins wherein the bobbin package is not contacted so as to be free of pressure marks and there is a minimum of contamination of the bobbin package so as to avoid loss of the outermost thread layers.

Now in order to implement these and still further objects of the invention, which will become more readily apparent as the description proceeds, the inventive method of automatically changing textile bobbins on a cantilevered bobbin chuck of a textile winding machine, is generally manifested by the following automatically carried out consecutive steps:

a. cutting and sucking-off a thread moving towards a textile bobbin package placed on the bobbin chuck;

b. taking-off the textile bobbin package from the stopped bobbin chuck and transferring it to a transporting device held in readiness;

c. positioning an empty bobbin tube;

d. placing the empty bobbin tube onto the stopped bobbin chuck; and e. rethreading the sucked-off thread onto the empty bobbin tube placed on the bobbin chuck which in the meantime has been set into rotation.

The inventive bobbin change device for implementing the method with a bobbin tube gripper axially movable in the take-off direction arranged within two end positions on a rigidly arranged bobbin chuck for taking-off a bobbin tube supporting a wound bobbin package and for transfer it off ring or giving off onto a supporting bolt of a bobbin package transporting device held in readiness, is manifested by the features that a bobbin package tube-supporting arm arranged between a bobbin tube take-up position and a bobbin tube giving-off position is movable in a direction substantially at right angles with respect to the direction of movement of the bobbin tube gripper. Further, the axially movable bobbin tube gripper is movable in the sliding-on direction for sliding on an empty bobbin tube held in readiness onto the bobbin support arm, and that a thread cutting and suction device can be moved between a thread takeover position for cutting and sucking-off the thread moving towards the bobbin package and a thread transfer or giving-off position for transferring or giving-off the sucked thread to the bobbin tube slid or pushed onto the bobbin chuck.

In this arrangement the cutting and sucking of the thread can be effected by a straight forward movement from a starting position and the rethreading of the thread can be effected by a first pivoting movement and subsequently by a second straight movement from the same starting position.

Furthermore, a second rigidly arranged bobbin chuck can be provided parallel to the first bobbin chuck for pivotably and axially movably taking-up the thread cutting and suction device.

BRIEF DESCRIPTION OF THE DRAWINGS

The invention will be better understood and objects other than those set forth above, will become apparent when consideration is given to the following detailed description thereof. Such description makes reference to the annexed drawings wherein:

FIG. 4 is an enlarged and semi-schematic view of the bobbin tube gripper according to FIG. 2;

FIG. 5 illustrates the bobbin tube gripper according to FIG. 4 seen in the direction of the arrow IV;

FIG. 6 is an alternative embodiment of the bobbin tube gripper according to FIG. 4;

FIG. 7 illustrates the bobbin tube gripper according to FIG. 6, the gripper being shown in another position;

FIG. 8 illustrates the bobbin tube gripper according to FIG. 7 seen in the direction of the arrow V thereof;

DETAILED DESCRIPTION OF THE INVENTION

Figure 1:
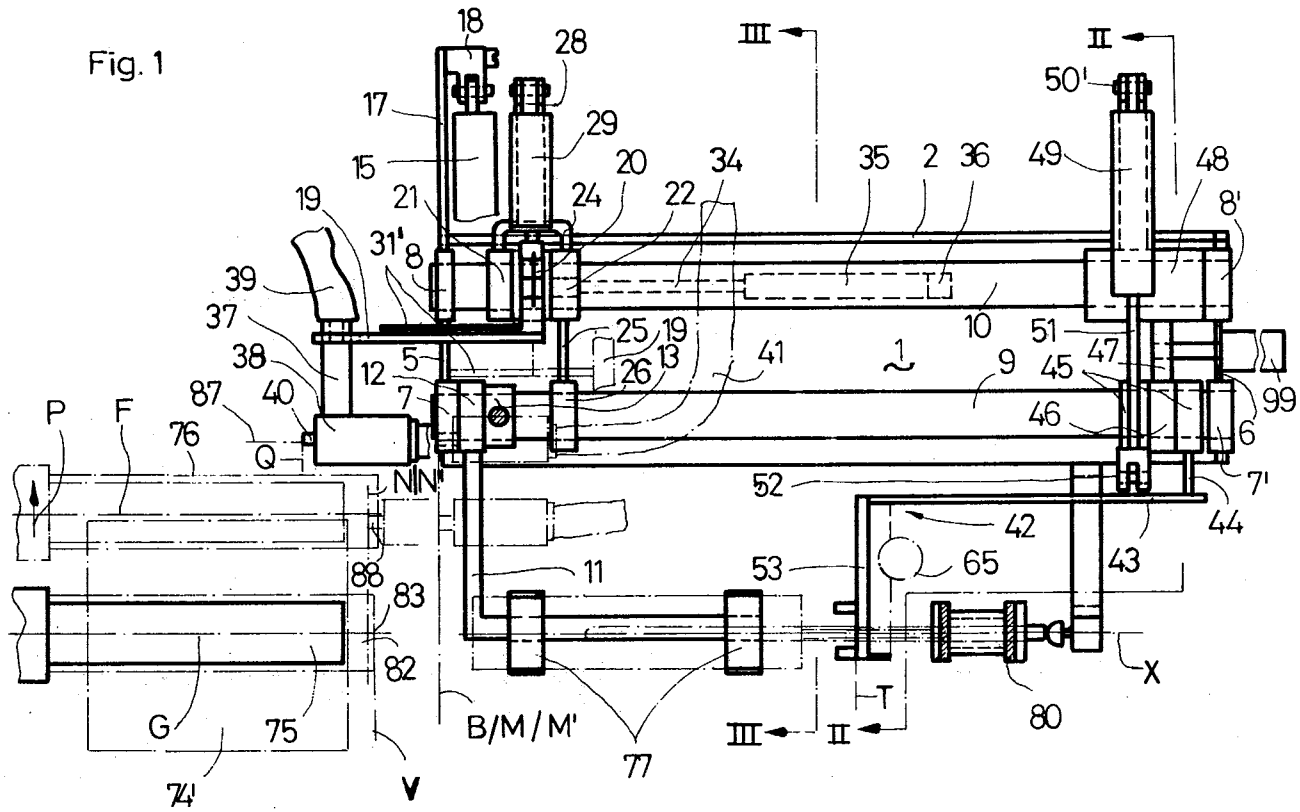
FIG. 1 is a semi-schematic top plan view of a bobbin change device with a suction nozzle and with a bobbin tube gripper and a transporting chain.

Describing now the drawings, a bobbin change apparatus 1 (FIG. 1) will be seen to comprise a base body 2 consisting of a bottom plate 4 connected with a movable (indicated in FIG. 14) support 3 (FIG. 2) and the front plates 5 and 6 respectively. The front plates 5 and 6 carry bearing or support members 7 and 7' and 8 and 8' (FIG. 1) respectively, connected with these front plates 5 and 6 respectively. The bearing or support members 7, 7' and 8, 8' in turn take-up supporting traverses or cross members 9 and 10 respectively, which are rigidly arranged and parallel. At the end of the support traverse 9 facing the front plate 5 there is supported a bobbin tube support arm 11 which is pivotable about the traverse 9 in a plane imagined at right angles to the traverses 9 and 10. The support arm 11 is pivotable in two pivoting sleeves 12 (FIG. 1) connected with the bobbin tube support arm 11 and movably mounted on the support traverse 9.

Figure 3:
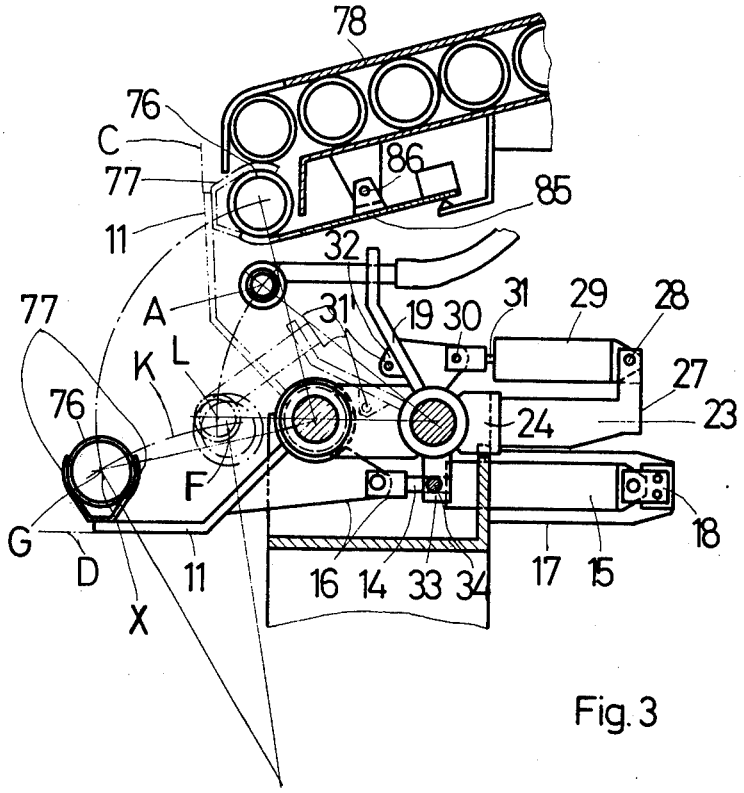
FIG. 3 is a semi-schematic cross-sectional view of the bobbin change device taken along the line III—III of FIG. 1 and showing the bobbin tube holder and the suction nozzle.

The sleeve 12 is secured against lateral displacement on the support traverse 9 between a fixing sleeve 13 provided on the support traverse 9 and fixable thereon by a set screw (not shown) and the support sleeve 7. Pivoting of the bobbin support arm 11 is effected by a piston 14 (FIGS. 1 and 3) of a pivotably supported pneumatic cylinder 15. Piston 14 is linked to the bobbin support arm 11 by a hinge element 16 (FIG. 3). The pneumatic cylinder 15 is pivotably attached to a hinge element 18 connected with a support 17. The support 17 is connected with the face plate 5 at the side of such plate 5 which is opposite the bobbin support arm 11.

On the end of the support traverse 10 facing the face plate 5 there is pivotably supported a nozzle support arm 19 (FIGS. 1 and 3) in a plane imagined at right angles to the support traverses 9 and 10 and axially movable. For this purpose the nozzle support arm 19 is connected with a sleeve 20 (FIG. 1) movably arranged on the support traverse 10. Adjacent to sleeve 20 and on both sides thereof there is arranged a further sleeve 21 and 22 on the support traverse 10 in the axial direction of such support traverse 10. The sleeves 21 and 22 are interconnected by a rigid bracket or arcuate member 24 (FIGS. 1 and 3) which is rigidly associated with a support member 23 (FIG. 3) in such a manner that, on the one hand, the sleeve 20 connected with the nozzle support arm 19 is independently pivotable with respect to the adjacent sleeves 21 and 22, and, on the other hand, is axially movable only together with the sleeves 21 and 22. The sleeve 22 furthermore is connected with a sleeve 26 arranged axially movable on the support traverse 9 by means of a rigid connecting member 25.

As seen by referring to FIG. 3 the support 23 at its end 27 opposite to the bracket or arcuate member 24 is pivotably connected with a pneumatic cylinder 29 via a hinge bolt or pin 28. Furthermore, the nozzle support arm 19 is articulated to the piston 31 of the cylinder 29 by a hinge or link 30. In close vicinity to the bottom surface of the nozzle support arm 19 facing the support traverse 9 there is provided a fixing or arresting pin 31' (FIGS. 1, 3 and 11) directed towards the face plate 5 and arranged in a web 32 rigidly connected with the support arm 19. The arresting or fixing pin 31', on the one hand, is axially movable in the web 32, but, on the other hand, can be fixed by a set screw (not shown) provided in such web 32.

Furthermore, a web 33 (FIG. 3) is rigidly connected with the sleeve 22 (FIG. 1) and with a piston 34 (FIGS. 1 and 3; in FIG. 1 indicated with broken lines) of a pneumatic cylinder 35 arranged parallel to the support traverse 10. The cylinder 35 is rigidly connected to the bottom plate 4 via a support member 36.

In the end of the nozzle support arm 19 directed away from the change apparatus 1 there is mounted a pneumatic tube 37, at the left end of which, as seen from the base body 2, a nozzle body 38 is rigidly connected with the tube 37. At the opposite end of the pneumatic tube 37 there is coupled a first flexible hose 39 connected to a suitable source of compressed air (not shown). The nozzle body 38 is disposed substantially parallel to the support traverses 9 and 10 and at its end facing away from the change apparatus 1 is provided with a conventional thread cutting and suction head 40 and thus not described in greater detail, whereas at the opposite end there is coupled a second flexible hose 41. The hose 41 leads to a thread waste receptacle (not shown).

Moreover, in FIG. 1 there will be seen a bobbin tube gripper 42 arranged to be pivotable about the support traverse 9 in an imaginary plane extending at right angles to the traverses 9 and 10 and movable parallel to the traverses 9 and 10 between the sleeves 22 and 26 respectively and the front plate 6.

Figure 2:
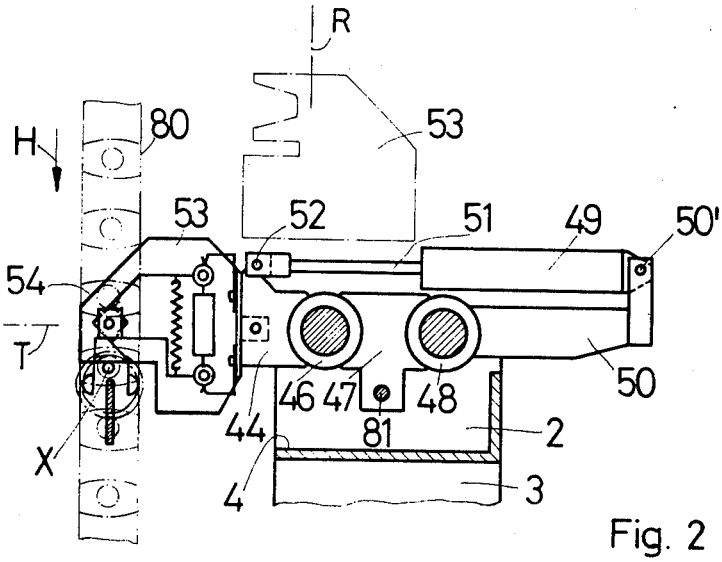
FIG. 2 is a semi-schematic cross-sectional view of the bobbin change device taken along the line II—II of FIG. 1 showing the bobbin tube gripper.

The bobbin tube gripper 42 consists of a supporting or support element 43 arranged substantially parallel to the traverse 9, the end facing the face plate 6 of which is rigidly connected via two webs or straps 44 (only one of which is shown in FIGS. 1 and 2) with sleeves 45 rotatable upon the traverse 9.

Between and adjacent to the sleeves 45 there is arranged a sleeve 46 which is movable on the traverse 9, said sleeve 46 being connected by a web or strap 47 or equivalent structure with a movable sleeve 48 oppositely arranged on the traverse 10.

Furthermore, a pneumatic cylinder 49 (FIGS. 1 and 2) is supported to be pivotable, substantially in a plane imagined at right angles to the traverses 9 and 10, at a supporting element 50 connected to the sleeve 48 by means of a hinge or pivot pin 50'. The piston 51 of the cylinder 49 is linked or articulated with one of the webs or struts 44 by a hinge pin 52.

On the end of the support element 43 confronting the face plate 5 there is arranged a gripper plate 53 substantially at right angles to the supporting traverses 9 and 10. The gripper plate 53 with its nose-shaped portion 54 (FIGS. 3, 4 to 6 and 12) extending away from the traverse 9 projects over an axis X (FIGS. 1, 2, 4, 5 and 12) in its position indicated with solid lines in FIGS. 1 and 2. A cylindrical bolt 55 supported in this nose-shaped portion 54 is used as a pivoting point for a plyers-type or clamp-type tensioning element 56 (FIGS. 5 and 6). The tensioning element 56 comprises two levers 57 and 58 with tensioning cams 59 and 60 respectively at the ends of the levers located at the region of the nose-shaped portion 54. These tensioning cams 59 and 60 are arranged substantially symmetrically on both sides of the axis X. Provided on each tensioning cam 59 and 60 is a gripper jaw or shoe 61 and 62 respectively, which extend substantially parallel to the traverses 9 and 10 respectively. In this arrangement the shoes 61 and 62 project past the gripper plate 53.

At the other end of each lever 57 and 58 there are provided bolts 63 and 64 respectively, for supporting or taking-up a single action pneumatic cylinder 65 and its piston 66.

The opposite spring ends 67 and 68 of a tension spring 69 acting against the piston force of the pneumatic cylinder 65 are connected with the levers 57 and 58 respectively. In order to center the gripper shoes or jaws 61 and 62 in the position shown in FIG. 4 a respective pre-tensioned spring 70 and 71 acts on the piston end 72 of the piston 66 and on the cylinder end 73 of the cylinder 65 respectively, the springs 70 and 71 being mounted on the support element 43.

A control mechanism 98 (FIG. 14) serves for activating the previously mentioned pneumatic cylinders in a proper timing sequence. A drive motor 100 serves for driving a chain 80 and a drive motor 101 serves to drive two wheels 103 rolling on rails 102 and which are part of the movable support 3. A further non-driven and not shown pair of wheels, also part of the movable support 3, roll on the same rails 102.

Furthermore, the control mechanism 98 is connected via a connection line 106 with a control device of a winding machine (not shown).

Figure 14:
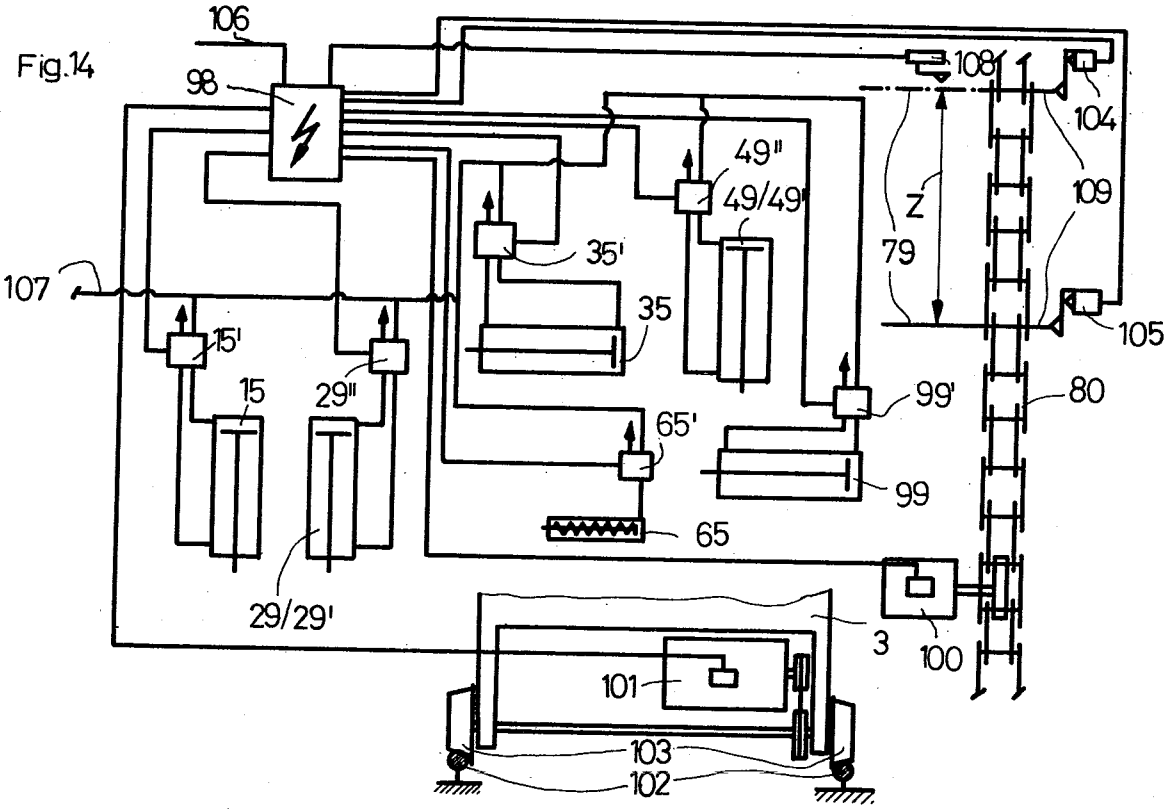
FIG. 14 is a wiring diagram.

The corresponding commercially available, conventional double-acting cylinders 15, 29 and 29', 35, 49 and 49' and 99 respectively, are activated by the control valves 15', 29'', 35', 49'' and 99' which are standard four-way electropneumatic valves available on the market and are connected with the mentioned cylinders in a generally known manner, so that there is dispensed with a more detailed description and designation of the connections between valve and cylinder shown in FIG. 14. The same applies essentially to the electro-pneumatic three-way valve 65'. Also the electrical connecting circuits shown in FIG. 14 between control mechanism 98 and the aforementioned control valves will be apparent from the showing so that no further discussion is here believed necessary.

These control valves are connected with a common compressed air supply duct 107 which, in turn, is connected to a compressed air supply plant (not shown).

Figure 15:
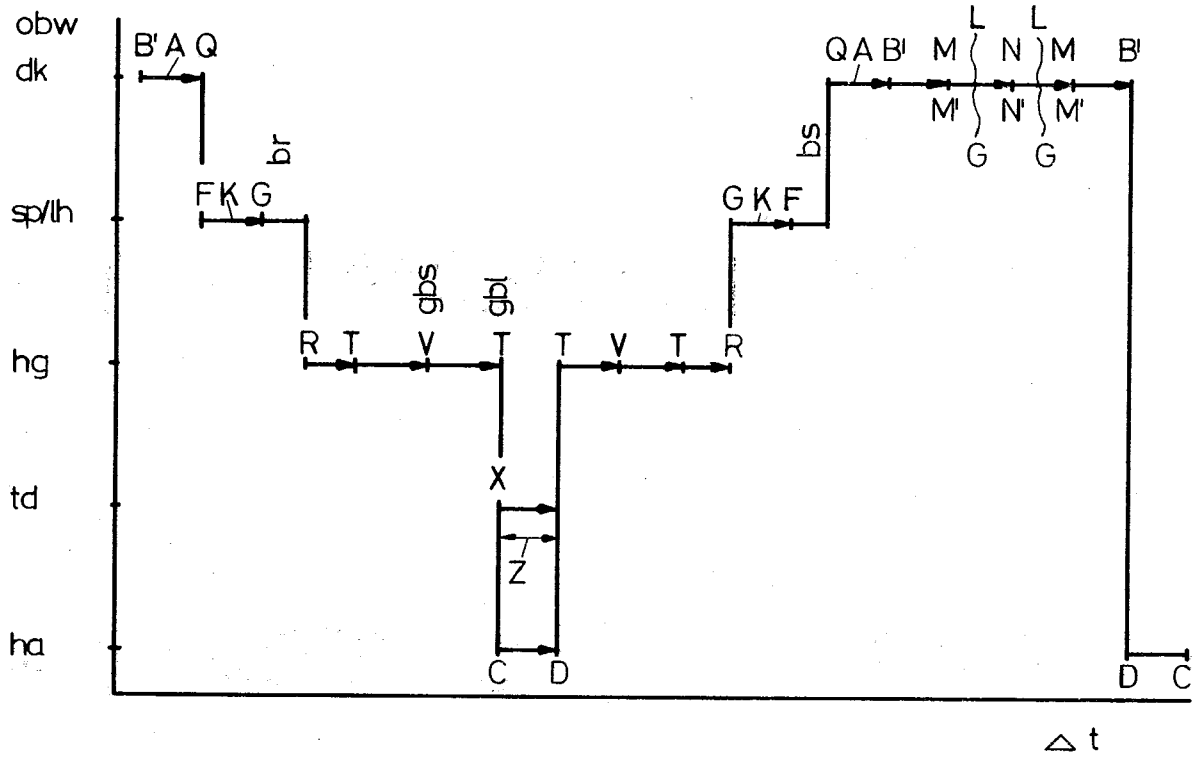
FIG. 15 is a schematic timing diagram.

The change apparatus now is operated in the following phases:

1. Preliminary Remarks a. In FIG. 15 a schematic timing diagram shows the sequence of the phases of movement during the change process. The abreviations indicated along the vertical axis of the diagram denote the following:

*obw* = object in motion
*dk* = cutting and suction head 40
*sp/lh* = bobbin chuck 75/empty tube 76
*hg* = bobbin tube gripper 42 and gripper plate 53 respectively
*td* = supporting bolt 79
*ha* = bobbin tube support arm 11 with clamps 77

Figure 13:
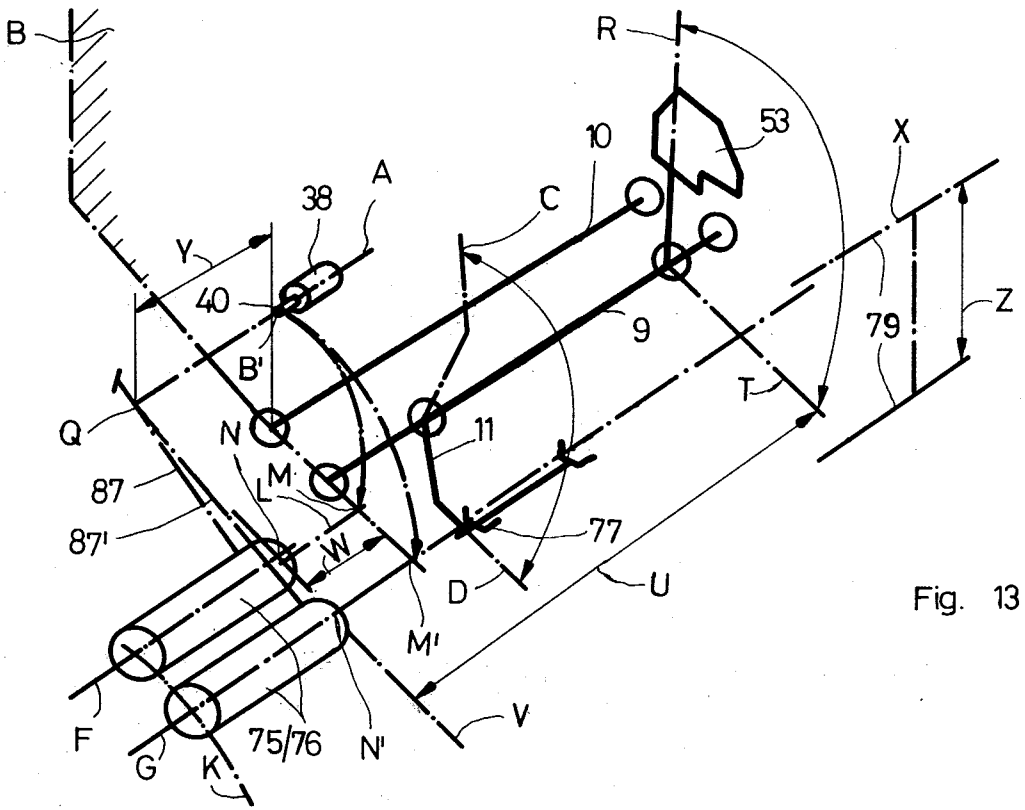
FIG. 13 is a schematic partial view of the change apparatus.

The time-delays indicated in the diagram do not correspond to the time scale of the effective time delays.

b. FIG. 13 shows schematically and in simplified manner the sequence of movements of the elements designated "object in motion" in FIG. 15.

c. As the bobbin package 74 (shown with dash-dotted lines in FIG. 11) builds-up on a bobbin chuck 75 rotating in the direction of the arrow P (FIGS. 1 and 11) in a winding machine (not shown), the bobbin chuck 75 due to the contact of the bobbin package on a fixedly positioned friction drive drum (not shown) driving the package moves on the circular path K (FIGS. 3 and 13) from a position F towards a position G. The position F (FIGS. 1, 3 and 13) is the position of the bobbin chuck 75 in which an empty bobbin tube 76 placed onto the bobbin chuck contacts the above mentioned friction drive drum, whereas the position G (FIGS. 1, 3, 11 and 13) of the bobbin chuck 75 is the bobbin change position of the bobbin chuck 75. In this position the bobbin chuck 75 has moved away from the friction drive drum so far that a full bobbin package 74' (FIG. 1) no longer contacts the friction drive drum.

d. The displacement of the bobbin chuck 75 upon reaching the full bobbin package to the position G is effected by the winding machine (not shown) in a manner not described here in greater detail.

2. In the starting position of the change apparatus, i.e. before the beginning of the bobbin change (of FIGS. 1, 2, 3, 11, 13 and 15):

a. The nozzle body 38 and the cutting and suction head 40 respectively, in its position A is in position B', i.e. behind, as seen from the bobbin chuck 75, an imaginary plane B at right angles to the traverses 9 and 10 outside the region of the bobbin chuck.

b. The bobbin support arm 11 is in the position designated C and in its tilted-up position indicated with dash-dotted lines, where bobbin tube clamps 77 (shown with dash-dotted lines in FIGS. 3 and 11) which are part of the bobbin tube support arm 11 already have taken up an empty tube 76 which is still located in a bobbin tube reserve box 78.

c. The bobbin tube gripper 42 is tilted-up in such a manner that the gripper plate 53 is located in the position designated R (FIG. 13).

d. The transporting chain 80 provided with support bolt 79 is moved in the direction of arrow H (FIGS. 2 and 11) in such a manner that a support bolt 79 is moved into the position indicated in FIG. 11 with phantom or dash-dotted lines and that the longitudinal axis of the bolt coincides with the axis X (FIGS. 1, 2, 4, 5, 11 and 13).

3. Upon completion of a full bobbin package 74' the valve 35' and thus the cylinder 35 is activated in such a manner that the nozzle body 38 and the cutting and suction head 40 respectively, are brought from the position B' (FIGS. 13 and 15) into a position in which they protrude into a so-called thread traversing triangle of the thread 87 formed by a thread guide 81 on the one hand and by a traversing stroke length L corresponding to the bobbin package length on the other hand. In this process the thread 87 coming in from the thread guide 81 is cut and sucked-off.

Subsequently the control mechanism 98 via the connecting circuit or line 106 transmits an impulse or pulse to the control device of the winding machine which causes the full bobbin package 74' to be pivoted from the position F (FIGS. 13 and 15) on the circular path K into the position G and to be subsequently brought to standstill by a conventional mechanism of the winding machine not here further considered.

Subsequently the cylinder 49 and the valve 49'' respectively are activated by the control mechanism 98 in such a manner that the bobbin tube gripper 42 and the gripper plate 53 respectively, are pivoted from the position R into the position T in such a manner that the gripper shoes or jaws 61 and 62 are placed to either side of the supporting bolt 79. Immediately afterwards a cylinder 99, the piston 81 (FIGS. 1 and 2) of which is connected with the web or strut 47 is activated by the control mechanism 98 and the valve 99' respectively, in such a manner that the gripper plate 53 is moved from the position T through the distance U into the position V. In this position the gripper plate 53 contacts a face side or end face 83 of the stopped bobbin tube of the full bobbin package 74'. In this arrangement the gripper shoes or jaws 61 and 62 protrude into the bobbin tube end 82 (FIG. 1) protruding past the bobbin chuck 75.

Subsequently the control mechanism 98 activates the valve 65' and the cylinder 65 respectively in such a manner that the spreading movement of the two tensioning cams 59 and 60 thus generated against the resistance of the tension spring 69 presses the gripper shoes 61 and 62 sufficiently strong against the inside wall of the bobbin tube end 82 to generate a contacting friction force sufficient for doffing or taking-off the full bobbin package 74' from the bobbin chuck 75.

After the release of the bobbin tube of the full bobbin package 74' on the bobbin chuck 75, which is effected immediately after stopping of the full bobbin package 74' by the winding machine, the valve 99' and thus the cylinder 99 are switched in reverse in such a manner that the bobbin tube gripper 42 together with the bobbin tube and the bobbin package 74' are moved back again from the position V towards the position T. The bobbin tube of the bobbin package 74' is placed onto the support bolt 79 until the bobbin tube practically contacts a stop 84 (FIGS. 4 and 11) mounted onto the transporting chain 80. Shortly before this contact is established the end face 83 of the bobbin tube activates a limit switch 108 (FIG. 14). By means of the pulse thus generated and transmitted by the limit switch 108 to the control mechanism 98 the valve 65' again is reversed by the control mechanism 98 in such a manner again that the piston of the cylinder 65 and thus also the gripper shoes 61 and 62 move back again activated by the tension spring 69. In this manner the aforementioned gripper shoes can be removed from the bobbin tube end 82 without friction. Since the release of the gripper shoes 61 and 62 occurs without interruption of the movement of the bobbin tube gripper all the way to the position T, the point in time of activation of the limit switch 108, i.e. the position of the limit switch 108, is to be determined experimentally such that there is prevented contact of the bobbin tube end 83 against the stop 84 before the gripper shoes are released. Usually the point of activation of the switch 108 will be chosen such that between the bobbin tube end 83 and the stop 84 a clearance of a few millimeters (not shown) is maintained.

Subsequently the control mechanism 98 activates the drive motor 100 for moving the chain 80 in the direction H by a predetermined step Z (FIGS. 11 and 14) in such a manner that the full bobbin package 74' placed on the support bolt 79 can be removed from the pivotal range of the bobbin support arm 11. This predetermined step Z can be terminated by providing a limit switch 105 (FIG. 14) which is activated by an end piece 109 of the bolt 79. The pulse thus generated by the limit switch 105 is transmitted to the control mechanism 98 and causes the drive motor 100 to stop. The step Z also can be effected by providing a timing relay operatively associated with the control mechanism 98.

Furthermore, the cylinder 29 is activated by the control mechanism 98 and the valve 29'' in such a manner that the bobbin tube support arm 11 is pivoted from its position C (FIGS. 3, 13 and 15) while simultaneously withdrawing the empty bobbin tube 76 already previously taken-up from the bobbin tube reserve box 78. The empty tube 76 is now arranged substantially coaxially with respect to the bobbin chuck 75 which is located in position G.

As the empty tube 76 is withdrawn from the bobbin tube reserve box 78 two retaining arms 85 (FIGS. 3 and 11) are pivoted about a common shaft or axis 86 in such a manner that the empty tube is released for withdrawal. After the withdrawal the further empty tubes placed above the withdrawn tube slide down until an empty tube again rests on the arms 85.

Thereafter the cylinder 99 is again activated in such a manner that the bobbin tube gripper is again moved from its position T in the direction of the bobbin chuck 75, i.e. into the position V. During this operation the gripper shoes 61 and 62, shown in FIGS. 4 and 5 in their rest or idling position, are inserted into the empty tube 76 located on the bobbin tube support arm 11 until the gripper plate 53 contacts the end face of the empty tube 76. Thus, the tube is removed from the tube clamps 77 and placed onto the bobbin chuck 75 located in its position G as the bobbin tube gripper 42 moves further forward.

Then the cylinders 99 and 49 are again activated in such a manner that the bobbin tube gripper 42 first is moved back from the position V into the position T and subsequently is pivoted up from the position T into the position R. Thus the bobbin tube gripper is again in its starting position.

Furthermore, the control device of the winding machine is activated by a pulse of the control mechanism 98 via the connecting line or circuit 106 in such a manner that the empty tube placed onto the bobbin chuck 75 and clamped by a conventional mechanism not here further described in detail is accelerated in that the bobbin chuck is moved from the position G into the position F (FIGS. 1, 3, 13 and 15) in such a manner that the empty tube contacts the rotating friction drive drum (not shown).

For placing the thread 87 still sucked-off by the nozzle body 38 onto the empty tube which is now rotating while in its position F, the cylinder 35 is firstly activated by the control mechanism 98 and the control valve 35' in such a manner that the nozzle body 38 and the head 40 respectively are moved back from the position Q to the position B' along the path Y, and secondly, the cylinder 29 is activated by the control mechanism 98 and the valve 29" respectively, in such a manner that the nozzle body 38 and the head 40 respectively are pivoted from the position B' into the position M, and thirdly, the cylinder 35 is again activated in such a manner that the head 40 with the thread sucked-off again is moved along the path L through the distance W towards the rotating bobbin tube until the head 40 with the thread 87 in the position N protrudes into the free end 82 of the bobbin tube and the thread is caught by a catching slot provided in the bobbin tube end and is severed by the head 40.

Figure 11:
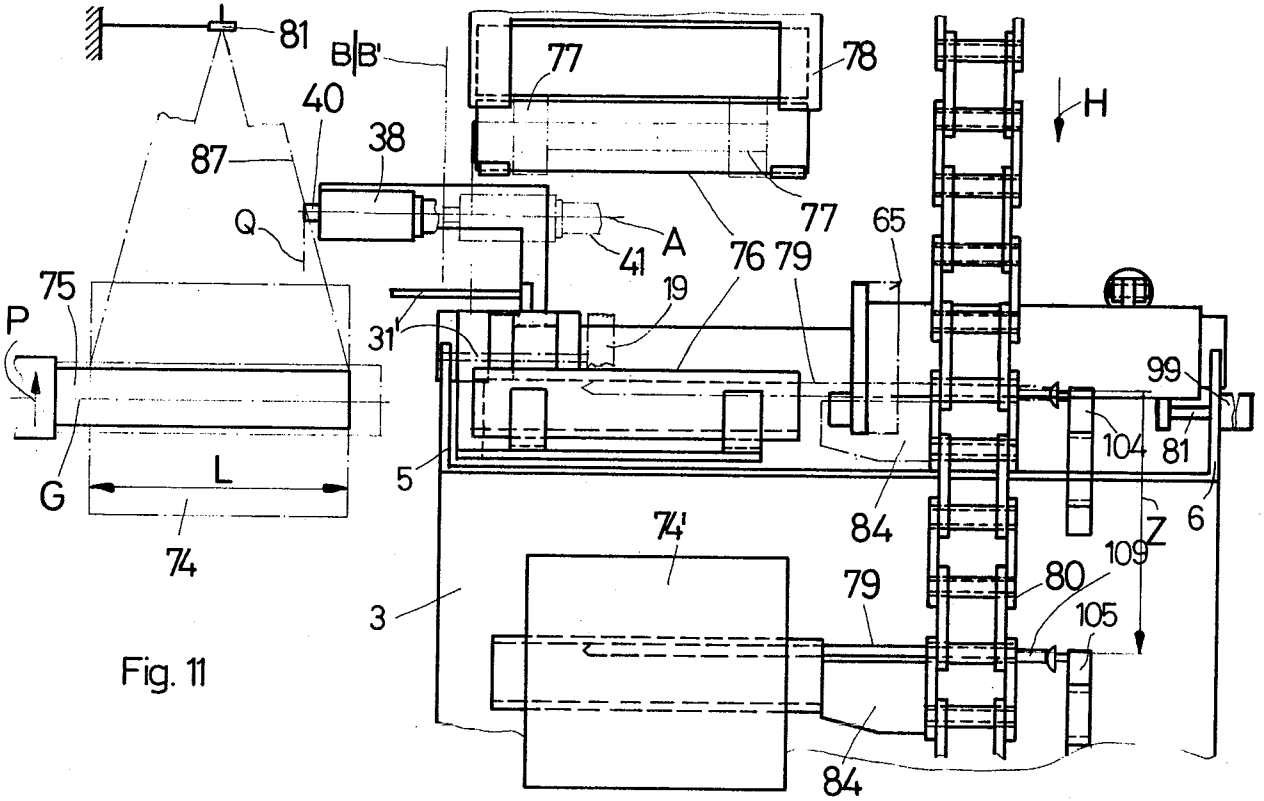
FIG. 11 is a side view of the change apparatus according to FIG. 1 and of a bobbin chuck.

The head 40 is prevented from being moved too far into the bobbin tube end 82, i.e. is prevented from contacting the rotating bobbin chuck in this position of the nozzle body by a stop or arresting bolt 31' contacting the face plate 5, as has been indicated in FIGS. 1 and 11 with dash-dotted lines.

After the thread transfer has been carried out, i.e. after a lapse of time preset in the control mechanism 98, the cylinders 35 and 29 are activated again in such a manner that the nozzle body 38 and the head 40 are retracted to the position M and pivoted up to the position B', i.e. to the starting position.

Finally, after pivoting-up the bobbin tube gripper 42, the control mechanism activates the drive motor 100 which further moves the chain 80 in the direction H until the end 109 of the next following empty support bolt 79 (indicated with dash-dotted lines in FIG. 11) activates a limit switch 104, the pulse of which transmitted to the control mechanism 98 causes the motor 100 to stop.

Thus, all elements of the change apparatus 1 are brought back to their starting position and are ready for the next bobbin tube change process.

In FIGS. 6 through 8 there is shown a modified embodiment of the centering of the tensioning cams 59 and 60, and the gripper shoes or jaws 61 and 62 respectively, with means other than the previously discussed springs 70 and 71.

The modified arrangement differs in that in a gripper plate 53' there are provided openings 89 and 90, each of which take-up a prolonged end portion 81 and 92 of a bolt 63' and 64' respectively.

Except for the prolonged end portions the bolts 63' and 64' correspond in their type and function to the previously discussed bolts 63 and 64.

All other elements of this arrangement correspond to the ones described with reference to FIG. 4 and FIG. 5 respectively.

Such alternative embodiment functions as follows:

In the starting position, as shown in FIG. 6, the ends or prolonged end portions 91 and 92 rest on a contact surface 93 and 94 respectively (FIG. 6) of the openings 89 and 90 respectively, and thus fix the tensioning cams 59 and 60 in such a manner that the gripper shoes 61 and 62 can be inserted into the bobbin tube end 82. As the cylinder 65 is activated against the tension force of the tension spring 69, as shown in FIG. 7, the ends 91 and 92 are lifted-off the surfaces 93 and 94 in such a manner that the tensioning cams 59 and 60, and thus also the gripper shoes 61 and 62 can pivot freely about the bolt 55 to a limited extent. The advantage of this modified version is seen in that the gripper shoes 61 and 62 adapt to the position of the bobbin tube to be gripped and to be removed or taken-off from the bobbin chuck 75 without generating a tilting moment about the axis X.

Figure 9:
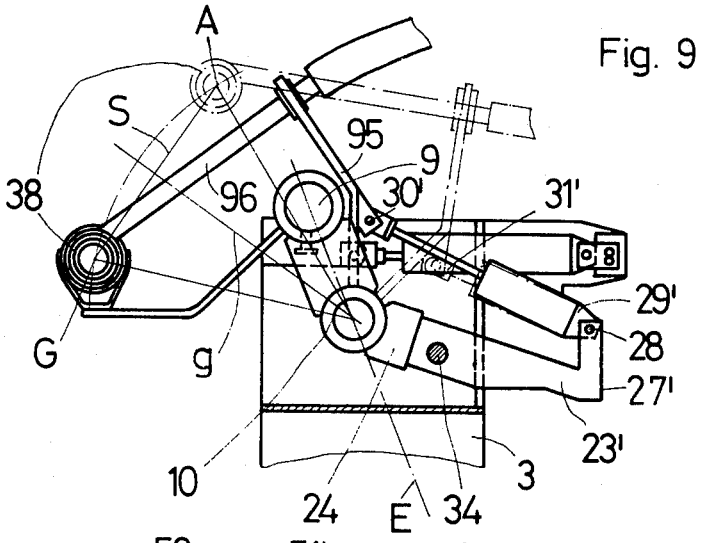
FIG. 9 is a variant embodiment of change apparatus according to FIGS. 1 and 3.

In FIG. 9 there is shown an alternative design example of the arrangement of the traverses 9 and 10 with a nozzle support arm 95 differing from the support arm 19 and with a pneumatic duct 96 differing from the pneumatic duct 37, such that there is possible a pivoting motion of the nozzle body 38 from the position B' to a position designated M' (FIG. 13) located on the axis G. The position G thus corresponds to the rotational axis of the bobbin chuck 75.

Correspondingly, upon completion of a full bobbin package 74' (for greater simplification of the drawing neither shown in FIG. 13 in the position F nor in the position G) the nozzle body 38 and the head 40 respectively, are moved into a thread traversing triangle formed by the thread 87' (FIG. 13) for cutting and sucking-off the thread as earlier discussed. The thread traversing triangle formed by the thread 87' is generated in the manner already described above for the thread 87.

For bringing the thread 87' which is sucked-off after the already described change operation into the empty bobbin tube 76 which is placed and accelerated on the bobbin chuck 75 rotating about the axis G the cylinders 29' (FIG. 9) and 35 respectively (FIG. 1) are activated in such a manner that the head 40 is moved along the path from Q to B', from B' to M', and from M' to N'. In this arrangement N' os located within the bobbin tube end 82 on the axis G. This differs in this alternative design example from the position N, which also is located within the bobbin tube end 82, but in a position L (FIGS. 3 and 13) adjacent to the position F.

The other change functions correspond to the function already described.

Figure 10:
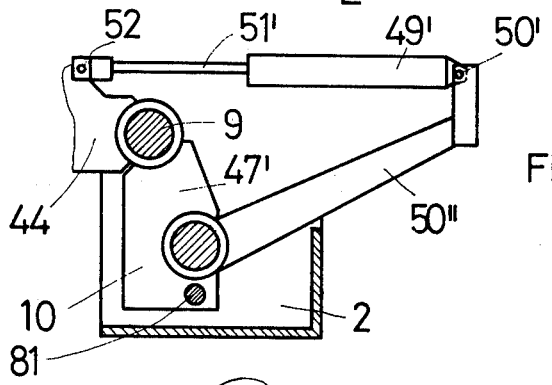
FIG. 10 is a variant embodiment of change apparatus according to FIGS. 1 and 2.
Figure 12:
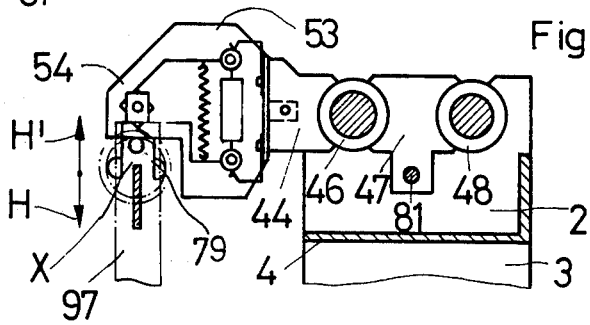
FIG. 12 is an alternative example of the change apparatus according to FIGS. 1 and 2.

The alternative arrangement of the traverses differs in that an imagined plane containing the traverses 9 and 10 is pivoted down about the traverse 9 from the original position, which was substantially horizontal, to such an extent that the longitudinal axis of the traverse 10 intersects with a straight line *g* which bisects the connection lines of the positions A and G and is located at right angles to this connecting line. Corresponding to this difference the elements 23, 27, 29, 30, 31, 47, 49, 50 and 51 discussed previously for design reasons are merely adapted as elements 23', 27', 29', 30', 31', 47', 49', 50' and 51' as shown in FIGS. 9 and 10.

The other functions during operation correspond to the functions already described.

If instead of the transporting chain 80 there is provided a transporting rod 97 for taking-up the supporting bolt 79, then there is not required the pivotability of the bobbin tube gripper 42 as described with reference to FIGS. 2 and 13, and the elements 49 through 52 and the corresponding functional steps can be dispensed with. The rod 97 and the supporting bolt 79 fixed thereon are brought in the direction of the arrow H' into the position shown in FIG. 12 for taking up the full bobbin package 74', and after taking-up the full bobbin package 74' are again moved in the direction of the arrow H. Both of these movement steps are effected in the same rhythm as the movement of the chain as described above for achieving the same functions.

Further advantages of the invention are seen in that:

a. with a minimum of movements a complete bobbin tube change including the thread transfer for changing and transferring the thread to the new empty bobbin tube is effected fully automatically; and b. the bobbin package itself remains untouched so that no pressure marks nor traces of contamination can be caused, which otherwise practically always means a loss of the outermost layers of thread.

While there are shown and described present preferred embodiments of the invention, it is to be distinctly understood that the invention is not limited thereto, but may be otherwise variously embodied and practiced within the scope of the following claims,

What is claimed is:

1. A method of automatically changing textile bobbins on a cantilevered bobbin chuck of a textile winding machine, comprising the steps of:

a. cutting and sucking-off a thread moving towards a textile bobbin package placed on the bobbin chuck;

b. stopping the bobbin chuck;

c. grasping the end region of the textile bobbin package and axially removing such textile bobbin package from the stopped cantilevered bobbin chuck and transferring it to a movable bobbin transporting device held in readiness in a direction substantially perpendicular to the direction of movement of said movable bobbin transporting device;

d. positioning an empty bobbin tube into a ready position for donning onto the bobbin chuck;

e. placing the empty bobbin tube onto the stopped bobbin chuck; and f. rethreading the sucked-off thread onto the empty bobbin tube placed on the bobbin chuck which in the meantime has been placed into rotation.

2. The method as defined in claim 1, wherein the steps of removing the textile bobbin package and the placing of the empty bobbin tube on the bobbin chuck are carried out along the same linear path of movement but in opposite directions.

3. The method as defined in claim 1, wherein the steps of removing the textile bobbin package and the placing of the empty bobbin tube on the bobbin chuck are carried out along the same linear path of movement but in opposite directions, and the positioning of an empty bobbin tube is carried out by a movement substantially at right angles to said linear movements.

4. The method as defined in claim 3, wherein the empty tube is positioned substantially coaxial with the bobbin chuck axis.

5. A bobbin change apparatus for automatically changing textile bobbins on a cantilevered bobbin chuck having a free end of a textile winding machine, comprising a bobbin package transporting device movable in a predetermined direction of travel, a bobbin tube gripper, means mounting the bobbin tube gripper to be axially movable in a bobbin package take-off direction between two terminal positions for taking-off a bobbin tube supporting a wound bobbin package from the free end of the bobbin chuck and for transferring the removed bobbin package to the bobbin package transporting device which is held in readiness, a bobbin package tube support arm, means for mounting said support arm for movement between a bobbin tube take-up position and a bobbin tube transfer position and in a direction substantially a right-angles with respect to the direction of movement of the bobbin tube gripper, said axially movable bobbin tube gripper being movable in a first direction for sliding an empty bobbin tube held in readiness by the bobbin tube support arm onto the free end of the bobbin chuck, a thread cutting and suction device, means for moving the thread cutting and suction device between a thread take-over position for cutting and sucking-off the thread moving towards the bobbin package and a thread transfer position for transferring the sucked-off thread to the bobbin tube supported on the bobbin chuck.

6. The bobbin change apparatus as defined in claim 5, wherein said mounting means for said bobbin tube gripper mounts the bobbin tube gripper to be axially movable substantially perpendicular to said predetermined direction of travel of said bobbin package transporting device.

7. The bobbin change apparatus as defined in claim 5, wherein the means mounting the bobbin tube support arm serves to pivotably support the bobbin tube support arm for a movement between two predetermined positions.

8. The bobbin change apparatus as defined in claim 5, further including mounting means rigidly arranged parallel to the gripper mounting means for pivotably and axially movably supporting the thread cutting and suction device.

9. The bobbin change apparatus as defined in claim 5, further including a bobbin tube reserve box arranged at the zone of pivotal movement of the bobbin tube support arm.

10. The bobbin change apparatus as defined in claim 5, wherein the mounting means for the bobbin tube gripper includes a traverse which mounts the bobbin tube gripper on and pivotably about said traverse.

11. The bobbin change apparatus as defined in claim 5, wherein the bobbin tube support arm is provided with substantially U-shaped bobbin tube clamps for engaging the empty bobbin tubes.

12. The bobbin change apparatus as defined in claim 11, wherein the bobbin tube clamps include movable gripper shoes, said gripper shoes being arranged such that in an end position of the bobbin tube support arm, in which an empty tube is held ready in a position substantially coaxial to the bobbin chuck by the bobbin tube support arm, said gripper shoes can be inserted into the bobbin tube.

13. The bobbin change apparatus as defined in claim 12, further including means for mounting the gripper shoes to be movable to a limited extent.

14. The bobbin change apparatus as defined in claim 13, wherein the means limiting the movement of the gripper shoes comprise springs.

15. The bobbin change apparatus as defined in claim 13, wherein the means limiting the extent of movement of the gripper shoes comprise bolt means having bolt ends protruding through means defining an opening.

* * * * *

UNITED STATES PATENT AND TRADEMARK OFFICE

CERTIFICATE OF CORRECTION

PATENT NO. : 4,052,017

DATED : October 4, 1977

INVENTOR(S) : Hugo Schär

It is certified that error appears in the above-identified patent and that said Letters Patent are hereby corrected as shown below:

Column 2, line 41, read "for transfer it off ring or giving off" as --for transferring or giving it--

Column 5, line 24, read "(FIGS. 5" as --(FIGS. 4--

Column 6, line 52, read "of FIGS. 1" as --cf FIGS. 1--

Column 9, line 55, read "81" as --91--

Column 10, line 38, read "os" as --is--

Signed and Sealed this

*Fifteenth* Day of *August 1978*

[SEAL]

*Attest:*

RUTH C. MASON
*Attesting Officer*

DONALD W. BANNER
*Commissioner of Patents and Trademarks*